US011534799B2

(12) United States Patent
Malmberg

(10) Patent No.: US 11,534,799 B2
(45) Date of Patent: Dec. 27, 2022

(54) SCREENING MEDIA

(71) Applicant: SANDVIK SRP AB, Svedala (SE)

(72) Inventor: Mats Malmberg, Rydsgard (SE)

(73) Assignee: SANDVIK SRP AB, Svedala (SE)

( * ) Notice: Subject to any disclaimer, the term of this patent is extended or adjusted under 35 U.S.C. 154(b) by 0 days.

(21) Appl. No.: 17/251,883

(22) PCT Filed: Jun. 15, 2018

(86) PCT No.: PCT/EP2018/066011

§ 371 (c)(1),
(2) Date: Dec. 14, 2020

(87) PCT Pub. No.: WO2019/238248

PCT Pub. Date: Dec. 19, 2019

(65) Prior Publication Data

US 2021/0387233 A1 Dec. 16, 2021

(51) Int. Cl.
*B07B 1/46* (2006.01)
*B07B 1/28* (2006.01)
*B07B 1/50* (2006.01)

(52) U.S. Cl.
CPC ..... *B07B 1/469* (2013.01); *B07B 1/28* (2013.01); *B07B 1/4645* (2013.01); *B07B 1/50* (2013.01)

(58) Field of Classification Search
CPC ..... B07B 1/469; B07B 1/4663; B07B 1/28; B07B 1/4645; B07B 1/50
See application file for complete search history.

(56) References Cited

U.S. PATENT DOCUMENTS 5,810,407 A * 9/1998 Melendez ..... A01K 1/0114 294/49
6,769,550 B2 8/2004 Adams et al.
11,135,618 B2 * 10/2021 Malmberg ..... B07B 1/48
2003/0012833 A1 * 1/2003 Freissle ..... B07B 1/4645 425/1
2003/0136710 A1 7/2003 Adams et al.
2005/0067327 A1 * 3/2005 Adams ..... B07B 1/469 209/408
2007/0175802 A1 8/2007 Johnson et al.
2008/0312477 A1 * 12/2008 Raichle ..... B07B 1/469 568/955
2010/0140147 A1 * 6/2010 Olsen ..... B07B 1/4645 209/392

(Continued)

FOREIGN PATENT DOCUMENTS

CA 3042750 A1 5/2018
CN 103648665 A 3/2014

(Continued)

*Primary Examiner* — Michael McCullough
*Assistant Examiner* — Jessica L Burkman
(74) *Attorney, Agent, or Firm* — Corinne R. Gorski

(57) ABSTRACT

Screening media for screening material includes a main body and a plurality of openings extending through the main body between a contact face and back face. The openings are of a shape of a convex and non-regular polygon, and are arranged in an orientation such that a line through the most proximal vertex of the polygon and parallel to a defined material flow direction divides the most proximal interior angle of the polygon. Such a configuration allows the openings to not easily get pegged and to improve screening performance.

18 Claims, 13 Drawing Sheets

(56) References Cited

U.S. PATENT DOCUMENTS

2015/0202658 A1* 7/2015 Bakula ..... B07B 1/28
209/403

FOREIGN PATENT DOCUMENTS

| | | | |
|---|---|---|---|
| DE | 202010001595 | U1 | 4/2010 |
| JP | 2012240003 | A | 12/2012 |
| KR | 20040092710 | A | 11/2004 |
| KR | 20130050725 | A | 5/2013 |
| RU | 1777970 | A1 | 11/1992 |
| RU | 81910 | U1 | 4/2009 |
| RU | 85371 | U1 | 8/2009 |
| RU | 2458748 | C1 | 8/2012 |
| SU | 1745369 | A1 | 7/1992 |
| WO | 84/02879 | A1 | 8/1984 |
| WO | 2005092523 | A1 | 10/2005 |
| WO | 2014179512 | A1 | 11/2014 |
| WO | 2018091095 | A1 | 5/2018 |

* cited by examiner

SCREENING MEDIA

RELATED APPLICATION DATA

This application is a § 371 National Stage Application of PCT International Application No. PCT/EP2018/066011 filed Jun. 15, 2018.

FIELD OF INVENTION

The present invention relates to screening media to screen material having a size distribution and in particular, although not exclusively, to a screening media having a specifically designed aperture shape.

BACKGROUND ART

Vibratory separators have been used commonly for various applications involving size-based segregation of material. One of the important applications of vibratory separators is found in mining and mineral processing industry where these separators or screening units, owing to the vibration of the screening media, separate the material fed on to them, into different grades based on the particle sizes. For this purpose, screening media is used, which has screening apertures through which stones smaller than the apertures pass through. Stones bigger than the screening apertures are transported from the top of the screening media and fed out at the end of the vibrating screen device. It is noticed that excessive usage of conventional screening media result in the phenomenon referred to as "blinding", which causes material lodging into the screening apertures which leads to plugged openings and inefficient screening. To address this issue, periodic "brushing" needs to be done by the operator of the device to dislodge the material from the screening apertures. This causes downtime of the machine, resulting in loss of productivity.

KR20040092710 discloses a screen mat for automatically removing cokes that clog rectangular holes by using air pressure. The screen mat 30 comprises a meshed air bag supporter 16 fixed in the main body 22, and rectangular holes 22-1 formed in the air bag supporter 16. The holes are in rectangular form and are arranged as a grid. Referring to FIG. 1 and FIG. 3*a* the material is supplied along one edge direction of the rectangular or the airbag carrier 16, i.e. in an orientation just as conventional design.

WO2018091095 describes a wear resistant screening media, the screening media having a specifically configured contact face adapted to be self-protecting in use, in particular, the screen contact face is covered by a repeating textured pattern, thus without the need for one or more abrasion resistant layers typically formed from a high hardness material such as a metallic mesh or the like. FIG. 4 shows a rectangular aperture, however FIG. 1 shows the material flow 15 on the screen deck is generally aligned with one edge of a rectangular aperture.

In normal screening operations using conventional screen devices, a large percentage or amount of the holes are likely to be blocked by the material particles after the screening process runs for a certain period of time, for example after one hour. This reduces the screening efficiency remarkably. Further, clogged holes tend to hinder the walking speed of the material flow, this again results in coal accumulation phenomenon on local or part of screen surface where coal particles get accumulated and piled on local area of the screen surface.

SUMMARY OF THE INVENTION

It is understood that the screening process, in the sense of the particles' movement and the screening mechanism, is a complex stochastic process, the present invention focuses on important factors such as the opening shape, size, and the orientation of openings that may have impacts on screening performance.

It is an objective of the present invention to provide a screening media that has holes which do not easily get pegged or blinded. It is a further objective of the present invention to provide screening media that improves screening performance in comparison to the use of conventional screen devices, in particular, it is an intention to increase the probability for a particle to pass through a hole at one-time. By one-time passing through a hole, it means: upon a particle approaching a hole, it shall pass at this single time, without the need to run over to a sequential hole and have a second try. If a particle attempts but fails to pass through a hole, it seeks additional attempts, as a result, the number of particles passing through the screening mat per time unit is then reduced, i.e. lower screening performance is observed. It is a further objective of the present invention to provide a screening media that accelerates the screening and increases the screen capacity.

The objectives are achieved by providing a screening media having a specifically configured openings. The idea is, to use non-regular polygon openings that are oriented such that the most proximal interior angle is divided by a line through the most proximal vertex of the polygon and parallel to a defined material flow direction ("proximal" or "upstream" herein denotes: situated close to the observer, seeing along a material flow direction. "distal" or "downstream" is meant the contrary). This allows the particles to reach the hole at a most proximal vertex or an inclined edge rather than by approaching the hole at a side normal to the material flow direction. The inclined edge together with a consecutive edge along the material flow direction constitute substantially a plow-shaped bank, which facilitates to guide the particles to fall into the hole Since a plow-shaped bank may guide the particles to alter their running direction and path, for instance to alter from straightforward movement to a curved movement. Further, the plow-shaped bank may cause the particles to self-spin and/or whirl towards the hole centre, or intensify their spinning or whirling, consequently allowing them to pass through the hole more easily, and reduce the likelihood of their getting stuck in the hole. Herein non-regular (irregular) polygons are referred to those polygons that do not have congruent interior angles or equal sides.

In addition, due to the plow-shaped bank, the contact time and/or contact area in which a particle interacts with the hole tends to be reduced, this also permits material that is pegging the hole to be relieved.

Further, the idea is to use non-regular polygon openings that can be reshaped from regular polygons. Considering a screening media has openings of regular polygon shape corresponding to a desired maximal material particle size, according to the present invention, the openings are to be slightly expanded from the regular polygon, preferably expanded directional—along a single direction, thus reshaped to a convex and non-regular polygon. The term 'expanded' should be understood to mean it indicates the area of the polygon is increased. The term 'slightly' means the change in side length, interior angle, area or any combination thereof shall not be so significant in comparison to an original value, otherwise it may result in material contamination. In the invention, the opening is expanded just slightly larger than necessary such that material contamination by larger size particles is prevented. An expansion ratio up to 30% is acceptable. Expanding a polygon may be achieved by extending at least two opposite sides or at least two adjacent sides or add sides.

The screening media of the invention is capable of increasing the probability for a particle to pass through a hole at one-time. Because the hole is expanded e.g. scaled or stretched, this helps to counteract or cope with the material flow speed. As the material flow speed is high (the material flow speed shall not to be too slow, otherwise it is easy for the particles to get pegged), due to the inertia, the particles may simply fail or miss to fall into the hole at one-time, i.e. the particles are prone to flit over and escape from the hole. It is generally understood, expanded openings makes it easier for the particles to pass through; slight extension along the running direction offers more time and space for guiding the particle to move forward, this provides the particles with the possibility of having more further movements. It also allows the particles to further interact with neighbouring edges of the openings or to further alter their incident direction in horizontal or vertical plane when hitting a distal edge, and enables the particles to bounce back or to be deflected to bump against another edge, finally re-entering the hole.

According to the invention, each hole is capable of 'actively' entrapping or catching a particle; on the contrary, in the conventional method the particle shall find a hole to pass through.

Since the screening media reduces the pegging or blinding of holes by material particles, further, it contributes to increase the probability for a particle to pass through a hole at one-time, consequently the number of particles passing through each hole per time unit increases. Thus, an accelerated screening effect will be observed; correspondingly, more material may be fed per time unit onto the screening media for processing, and therefore the material throughput or the screen capacity will be increased.

According to a first aspect of the present invention there is provided a screening media for being arranged in a screening equipment for screening material, the media comprising: a main body having a contact face adapted to contact material to be screened and a back face opposite to the contact face; a plurality of openings extending through the main body between the contact and back faces; wherein a cross sectional area of the openings in a plane perpendicular to the thickness of the media is of a polygon that is convex and non-regular polygon, preferably, the polygon is non-equilateral; wherein the openings are arranged in an orientation such that a line through a most proximal vertex of the polygon and parallel to a defined material flow direction divides the most proximal interior angle of the polygon, wherein the most proximal interior angle is the interior angle associated with said most proximal vertex. Optionally, the line through the most proximal vertex of the polygon and parallel to a defined material flow direction forms an acute angle with respect to a diagonal through the most proximal vertex and a most distal vertex, the acute angle may range between 0 to 30 degrees. Thickness of the media is defined as the distance between the contact face and the back face.

In one embodiment, the most proximal interior angle is substantially a right angle, preferably the line substantially bisects the most proximal interior angle. As the most proximal interior angle is a right angle, a most proximal edge and a distal edge to build the plow-shape can be also normal to each other, such a plow-shape is efficient in guiding particles' movement; in addition, such a hole occupies the smallest area for a given desired maximal material particle in comparison to rhombus-shaped holes or other shaped holes used for screening media. Such a configuration is further beneficial to increase hole density (number of holes per unit area), thus enhancing screening performance. The most proximal interior angle can be in the range of 80 to 100 degrees.

In one embodiment, the non-regular polygon is a parallelogon being derivable from a regular polygon by expanding the regular polygon in such a way that the separation (or separation distance) defined between the most proximal vertex and a most distal vertex is increased, wherein the regular polygon having a side length corresponding to a desired maximal material particle size, preferably the regular polygon is expanded in such a way that at least one most distal edge is translated outwards. Size expansion of the regular polygon may only take place in a single direction—substantially in line with the material flow direction. A parallelogon can be obtained by scaling a rhombus or square along its one side (i.e. not scale along another direction). Optionally, a parallelogon can be obtained by expanding the area of a rhombus or square to a hexagon by translating outwards two distal sides of a rhombus or square along the diagonal through the two distal sides (not scale along another direction). The openings having a parallelogon form are advantageous for allowing simple tessellation scheme design of screening media with the openings, to allow the arrangement of a maximal number of holes, to relieve disturbance to the particles' movement along material flow and ensure material flow speed. Area expansion of a polygon occurs along the material flow direction, its advantages have been described above. On the contrary, expansion of a polygon along a direction normal to material flow would have no comparable improvement on entrapping particles.

In one embodiment, the non-regular polygon is of substantially rectangular shape, the short sides of the non-regular polygon having a length corresponding to a desired maximal material particle size. A rectangle can be obtained by scaling a square directionally, for example by scaling the square along either of the two pairs of parallel sides.

In one embodiment, the non-regular polygon is a hexagon that includes a first pair of substantially parallel opposite sides, a second pair of substantially parallel opposite sides, and a third pair of substantially parallel opposite sides, the first and second pairs of sides having substantially equal length, the first and second pairs of sides having a length corresponding to the desired maximal material particle size, the third pair of sides having substantially shorter length than the first and second pairs of sides, preferably the first and second pairs of sides are substantially perpendicular to each other.

Preferably, the main body comprises a textured pattern provided at the contact face, the pattern extends over all or a majority of the contact face. The textured pattern at an upward facing contact surface is configured to at least partially entrap 'fines' or smaller particulates of the material to be screened so at to build a protective bed or layer over the contact face. Thus, the contact face is adapted to be self-protecting in use. Advantageously, the textured contact face is adapted to be responsive to the magnitude of the abrasive contact with the material to be screened in that as the volume of material flowing over the bed increases, the protective material bed is continuously replenished, rebuilt and enhanced by the material flow.

Preferably, the tessellation scheme of the plurality of openings is a lattice structure. This allows to arrange maximal number of holes on the screening media.

Optionally, the main body comprises a single piece material and is preferably made of rubber or polymer material. Optionally, the main body comprises at least a first layer and a second layer bonded or attached together to form a composite structure, the first layer defining the contact face and the second layer defining the bottom face. The main body comprising a multi-layer structure is advantageous to facilitate manufacturing. In particular, the multiple layers may be formed from different materials or material compositions that may be bonded or attached together by thermal bonding or mechanical attachment means such as pins, screws, rivets, bolts of the like.

Preferably, the first layer comprises a first material and the second layer comprises a second material, the second material has a material characteristics being different from the material characteristics of the first material. Such a configuration is advantageous to facilitate manufacturing in that the textured pattern at the contact face may be formed conveniently by a 'branding' process at the contact surface, involving heating the main body and pressing a mesh (or other suitable substrate) into the first layer so as to imprint a roughened profile formed from peaks and valleys (troughs) according to the shape profile of the mesh (or substrate) as it is removed from the first layer. Optionally, this process may involve heating the main body and/or the mesh or substrate. The first layer may then be bonded to the second layer by a further heat pressing stage. Optionally, the first material of the first layer may be formed from a polymeric material including rubber, polyurethane and the like. Optionally, the second material of the second layer may comprise a polyester, a polyamide, nylon, carbon fibre and the like.

Optionally, the pattern is represented by peaks and troughs at the contact face, a depth of the pattern being defined as the separation distance between the projections of the peaks and troughs on an axis parallel to the thickness of the media wherein the depth of the pattern is in a range of 5% to 70% of a total thickness of the media between the bottom face and the peaks of the contact face, preferably the range of the depth is 0.05 mm to 10 mm, more preferably the range of the depth is 0.1 mm to 8 mm. Such a configuration provides the desired pocket or cavity size at the textured contact face to build the protective bed of material that covers the screening media and accordingly facilitates material-on-material abrasive contact. Such a configuration is further beneficial to continuously rebuild the protective layer as fines or small particulates (that are capable of being entrapped between the peak and troughs) are created by the abrasive material-on-material attrition as the bulk material flows over the protective bed. Such an effect ensures the screening media is continually protected and the desired wear resistance is provided.

Preferably, a width, length or diameter of each of the openings in a plane perpendicular to the thickness of the media is in a range 1 mm to 50 mm. Optionally, a cross sectional area of the openings in a plane perpendicular to the thickness of the media is generally uniform or increases through the thickness of the main body between the contact and bottom faces. Accordingly, the size of the openings may be generally uniform or may decrease through the thickness of the media such that a cross sectional area of the openings at the contact face may be approximately equal or may be less than the cross-sectional area of the openings at the bottom face. Such a configuration is advantageous to allow the unhindered passage of material of the desired particulate size through the media and reduce the likelihood of blinding (blockage) of the openings by the flow of material.

Optionally, the main body comprises a support structure for supporting the screening media, the support structure being formed together with the screening media as an integral structure.

According to a second aspect of the present invention there is provided a screening module for screening bulk material, the module comprising: a pair of sidewalls; a plurality of support means, wherein the plurality of support means together with the pair of sidewalls form a frame structure; and a screening media according to any embodiment as described above mounted or indirectly mounted upon the plurality of support means and extending between the sidewalls. In particular, the screening media is arranged in an orientation such that the defined material flow direction (associated with the screening media) is in line with the longitudinal direction of the sidewalls.

Optionally, the screening module includes two or more screening media arranged sequentially along the defined material flow direction, wherein a downstream screening media having a sunk or lowered contact face relative to an upstream neighbouring screening media.

According to a third aspect of the present invention there is provided a screening equipment for screening material, comprising: at least one screening media according to any embodiment as described above; a frame for supporting the at least one screening media; a vibration generating means for imparting circular or reciprocating vibratory motion onto the at least one screening media.

According to a fourth aspect of the present invention there is provided a method for processing material in a screening equipment according to any embodiment as described above, the screening equipment comprising a screening media, the method comprising: setting the screening equipment to match a defined material flow direction; the screening equipment generating vibration of the screening media; the generated vibration and gravity driving the material moving on the screening media or passing through the openings of the screening media; wherein a cross sectional area of the openings of the screening media in a plane perpendicular to the thickness of the media is of a polygon that is convex and non-regular polygon, preferably, the polygon is non-equilateral, more preferably the non-regular polygon is a parallelogon being derivable from a regular polygon by expanding the regular polygon in such a way that the separation defined between the most proximal vertex and a most distal vertex is increased, wherein the regular polygon having a side length corresponding to a desired maximal material particle size; wherein a line through the most proximal vertex of the polygon and parallel to the defined material flow direction divides the most proximal interior angle of the polygon wherein the most proximal interior angle is the interior angle associated with said most proximal vertex.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
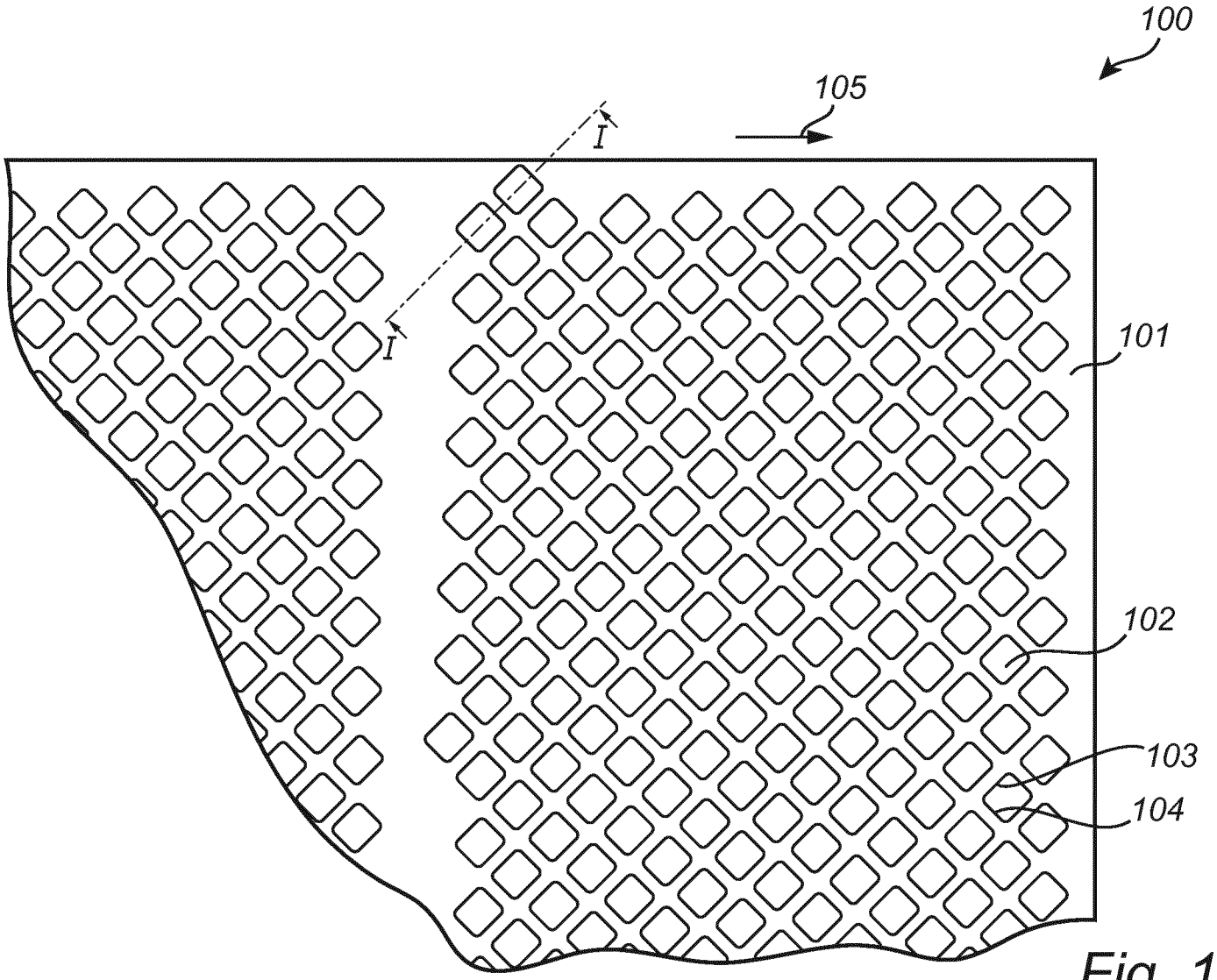
FIG. 1 is a plan view of a screening media according to a specific implementation of the present invention.

FIG. 1 shows a plan view of screening media 100, also called a screen cloth or a screen mat, which includes a plurality of openings 102 on the main body 101. Openings 102 comprise a generally rectangular cross sectional profile (in the plane of the contact face 301) and comprise a width and a corresponding length in a range 1 mm to 50 mm, typically 10 mm to 20 mm. Accordingly, the contact face 301 is defined in part by what may be regarded as cross beams 103 and 104 that extend between and at least partially define the openings 102. A relative width of the cross beams 103 and 104 (in a plane of contact face 301) is in a range 30% to 60% of the width of the openings 102. A defined flow direction of the material to be screened is indicated generally by arrow 105. The major axes MN of the rectangular apertures incline approximate 45 degrees relative to the material flow direction 105, in counter-clockwise direction from material flow direction 105 as indicated in angle β in FIG. 2. The openings are arranged in a tessellation scheme of a lattice structure, with the intention to ensure structure rigidity, whilst have maximal number of holes on the sheet. The screening sheet 101 may be made of rubber or polymer material such as polyurethane and the like. The openings may be produced by punch or perforation.

Figure 3A:
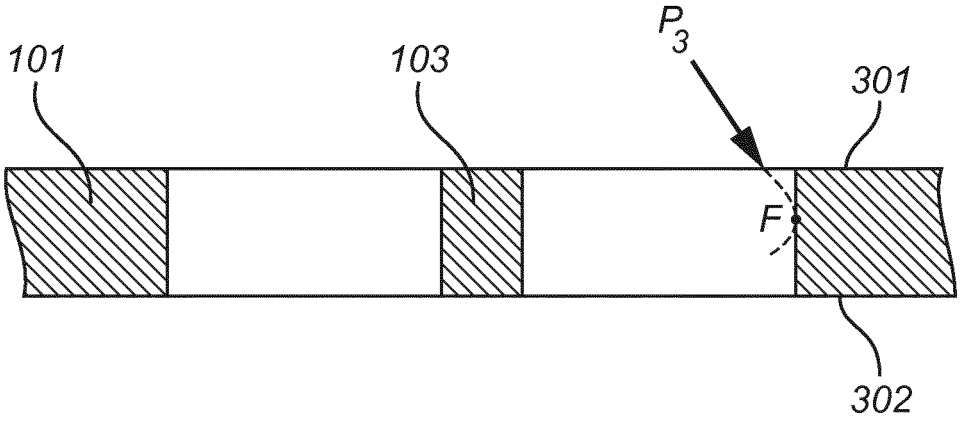
FIG. 3A is a cross sectional view taken in the direction of arrows along line I-I of FIG. 1.
Figure 3B:
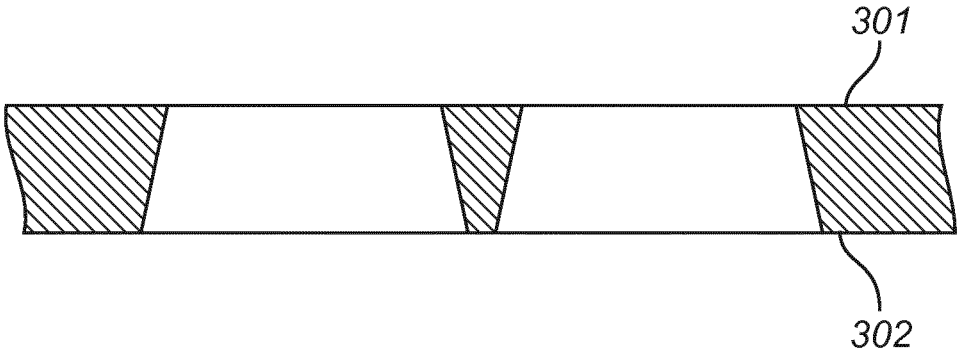
FIG. 3B is alternative cross sectional view taken in the direction of arrows along line I-I of FIG. 1.

Referring to FIG. 3A, a cross sectional view taken in the direction of arrows along line I-I of FIG. 1 is shown, the main body 101 has a contact face 301 adapted to contact material to be screened and a back face 302 opposite to the contact face, the cross-sectional shape profile of the openings is uniform through the thickness of the media 100 between the contact face 301 and the bottom face 302. According to another specific implementation, as shown in FIG. 3B, the width of the openings increases through the media 100 in a direction from the contact face 301 to the bottom face 302 such that a corresponding cross sectional area of the openings 102 perpendicular to the thickness of the media increases from the contact face 301 to the bottom face 302.

Figure 2:
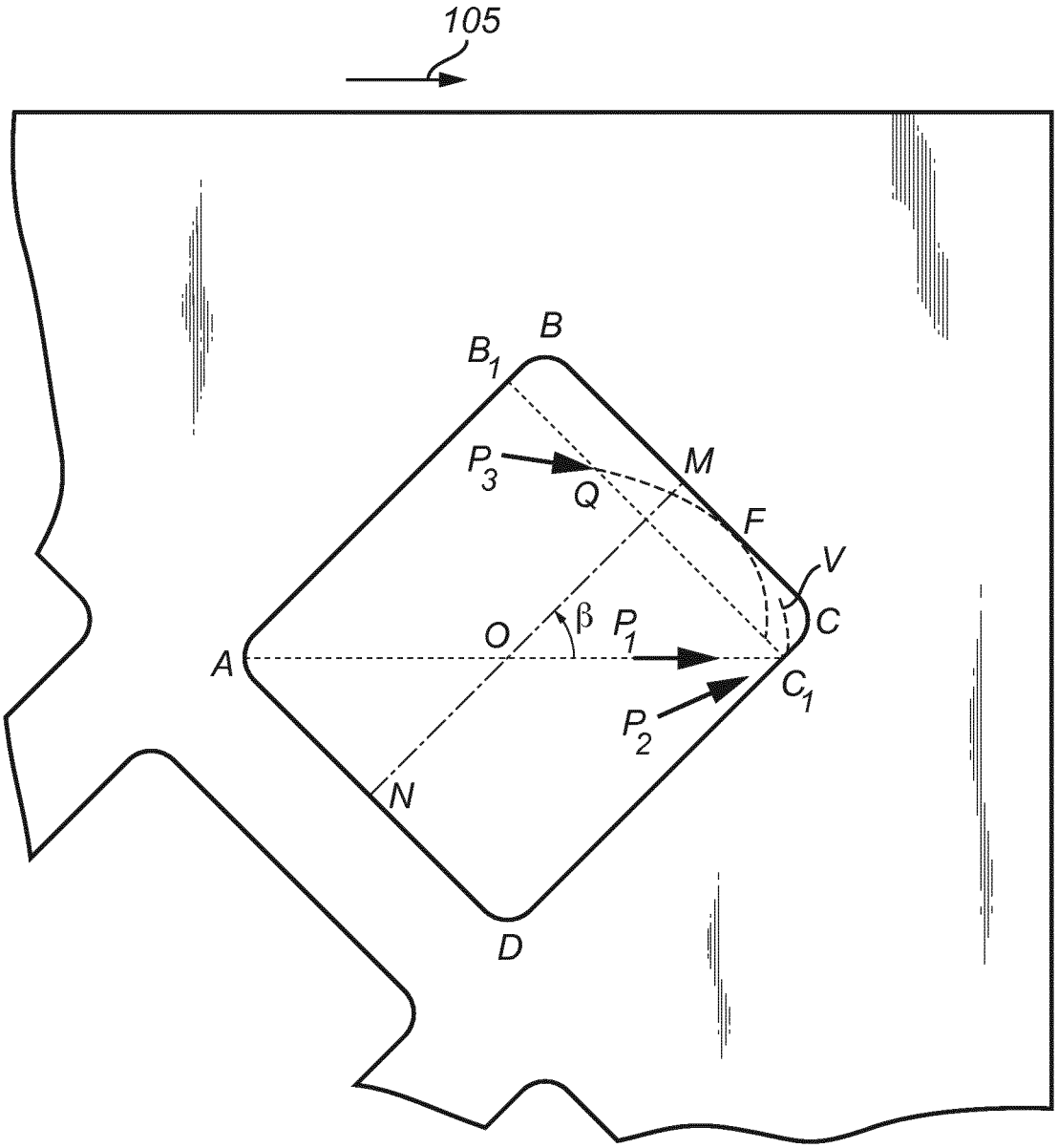
FIG. 2 is a magnified plan view of a part at upper right corner of a screening media of FIG. 1.

FIG. 2 shows a magnified plan view of a part of a screening media shown in FIG. 1. The rectangle hole may have round corners, but not necessarily to be so. The four vertices of the hole are denoted by ABCD, rectangle ABCD may be considered as being scaled from a square $AB_1C_1D$ along the axis OM that is parallel to edge AB. Rectangle $AB_1C_1D$ is seen as a virtual hole, its inscribed circle is subject to and corresponds to the desired maximal material particle size. In this example, the edge AD has a length of 14 mm, AB is 16 mm. The hole is oriented such that diagonal $AC_1$ is aligned with the material flow direction 105 and bisects the proximal interior angle ∠BAD. Diagonal AC and the line $AC_1$ (aligned with material flow direction 105) may form an acute angle which may range from 0 to 30 degrees. Now, edges AB and BC, AD and DC form respectively a plow-shaped bank (as the opening sinks below the contact face 301) relative to the material flow direction 105, where the edges AB and BC are substantially normal to each other. According to another specific implementation, edges AB and CD may not necessarily be strictly parallel to each other, certain deviation is acceptable, so are with edges AD and BC.

In the following, the screening process will be illustrated in exemplary scenarios, with aid of virtual square hole $AB_1C_1D$ as comparison. Supposing a particle is moving along direction $P_1$ or $P_2$ to enter the hole and approach an end vertex $C_1$ of the virtual square hole, and is not successful in passing through the virtual hole, it may be stuck there or flit over the hole. However, due to the hole already being scaled to ABCD, the particle shall move further forward along the curve V and may further bump on edge BC and bounce back to the centre of the hole. Considering another scenario: a particle is moving along the plow-shaped bank to enter the hole and reach point Q in direction $P_3$, but with failure to fall into the virtual hole, probably owing to the speed being a little too high; with the scaled hole, the particle may have further spacing QF to allow it descend until reaching point F (see FIGS. 2 and 3A), due to the drop movement in vertical plane, there is no longer chance for the particle to escape from the hole, but bounce back to further collide with edge CD. This will increase the likelihood of the particle being entrapped by the hole.

Figure 4:
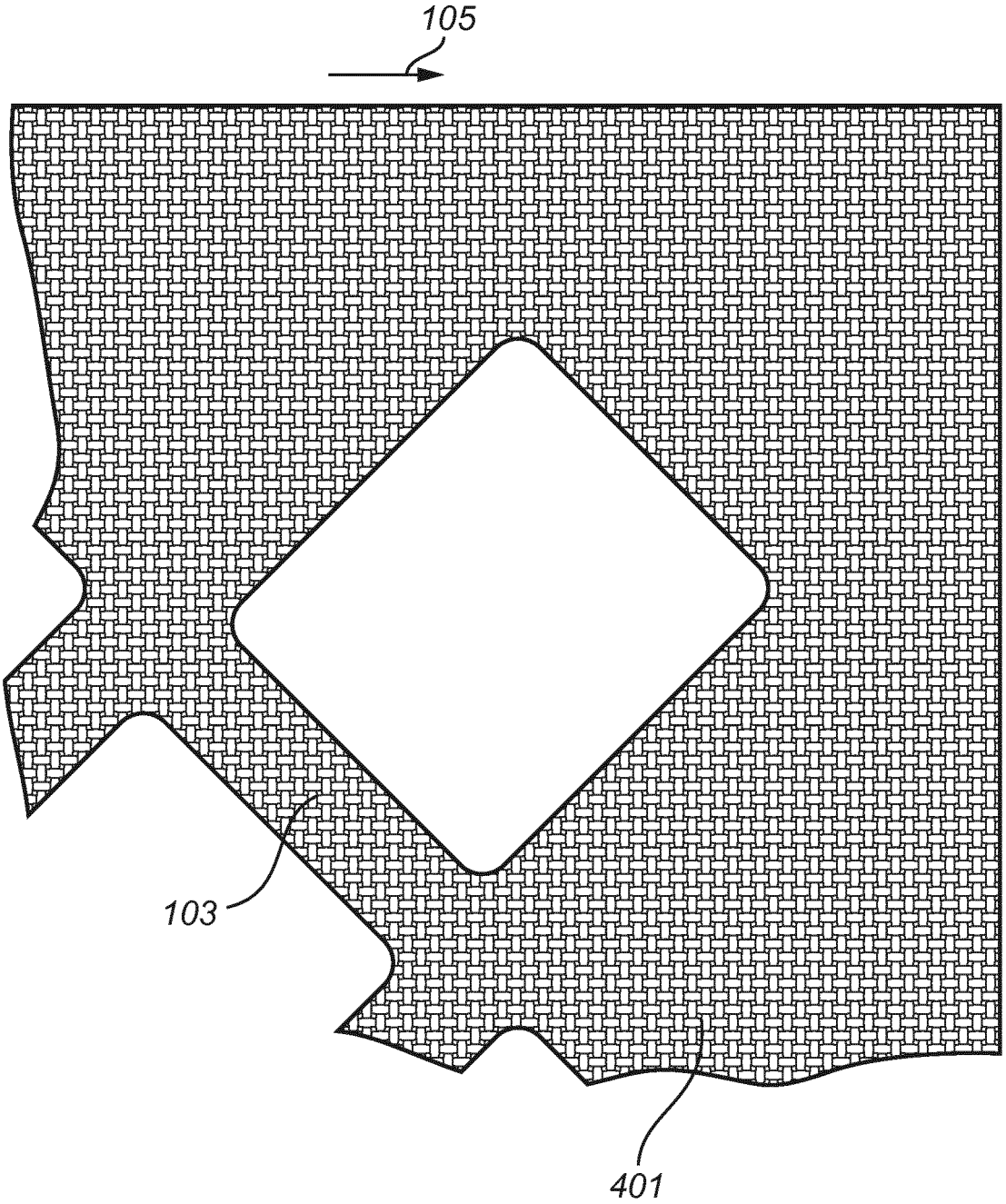
FIG. 4 is a magnified plan view of a part of a screening media according to another specific implementation of the present invention.

FIG. 4 is a magnified plan view of a part of a screening media according to another specific implementation. The screening media has similar structure as in FIGS. 1 to 3, comprising a generally planar shape profile having a generally planar contact face 301 and a generally planar opposite face 302, however, a textured pattern 401 is provided at the contact face 301 that accordingly comprises a surface roughness relative to the bottom face 302 that may be considered to be relatively smooth or non-profiled in comparison. The textured pattern provided at contact face 301 extends over the entire contact face 301 including the cross beams 103 and 104 defined between the openings 102. The textured pattern is formed from peaks 901 and respective troughs 902 that collectively define a repeating pattern at contact face 301. A relative depth of the textured pattern at the contact face 301 (defined as the separation distance between the projections of the peaks 901 and troughs 902 on an axis parallel to the thickness of the media 100) is much less than the total thickness W of the media 100 and the thickness $W_1$ of the first layer 903. In particular, the depth may be in a range 0.5 mm to 5 mm depending upon the thickness $W_1$ of the first layer 903.

The textured pattern may be a kind of 'repeating textured pattern' encompassing a profiled surface having regions of different height including raised and recessed parts. This term encompasses texturing provided at a surface by any one or a combination of ridges, ribs, lumps, projections, protuberances, grooves, cavities, pimples or channels. This term also encompasses the pattern being a regular repeating pattern and not a random collection of raised or recessed regions so as to be generally consistent and uniform over the contact face.

The texture profile design can be applied to any other embodiments of the present invention.

Figure 5:
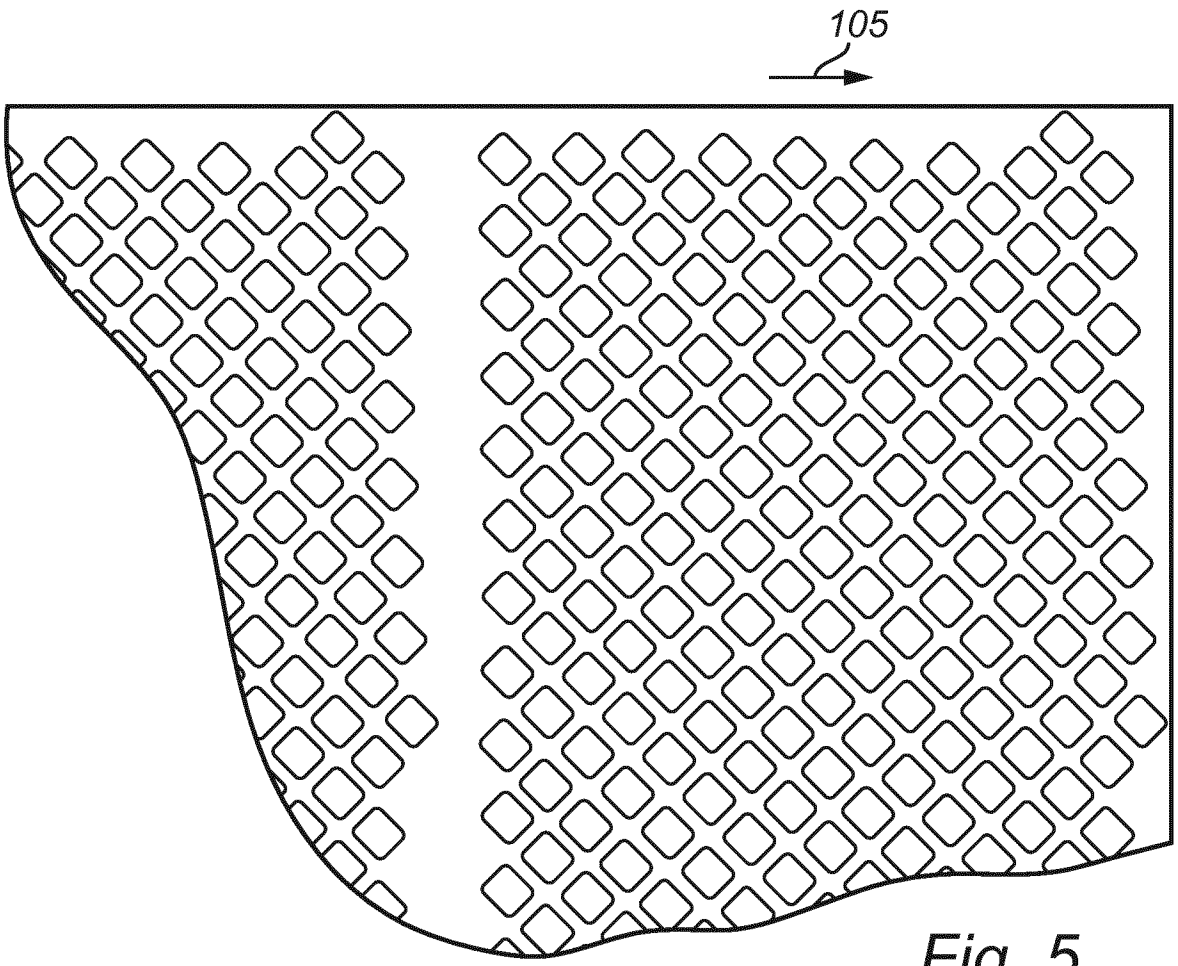
FIG. 5 is a plan view of a screening media according to a further specific implementation of the present invention.
Figure 6:
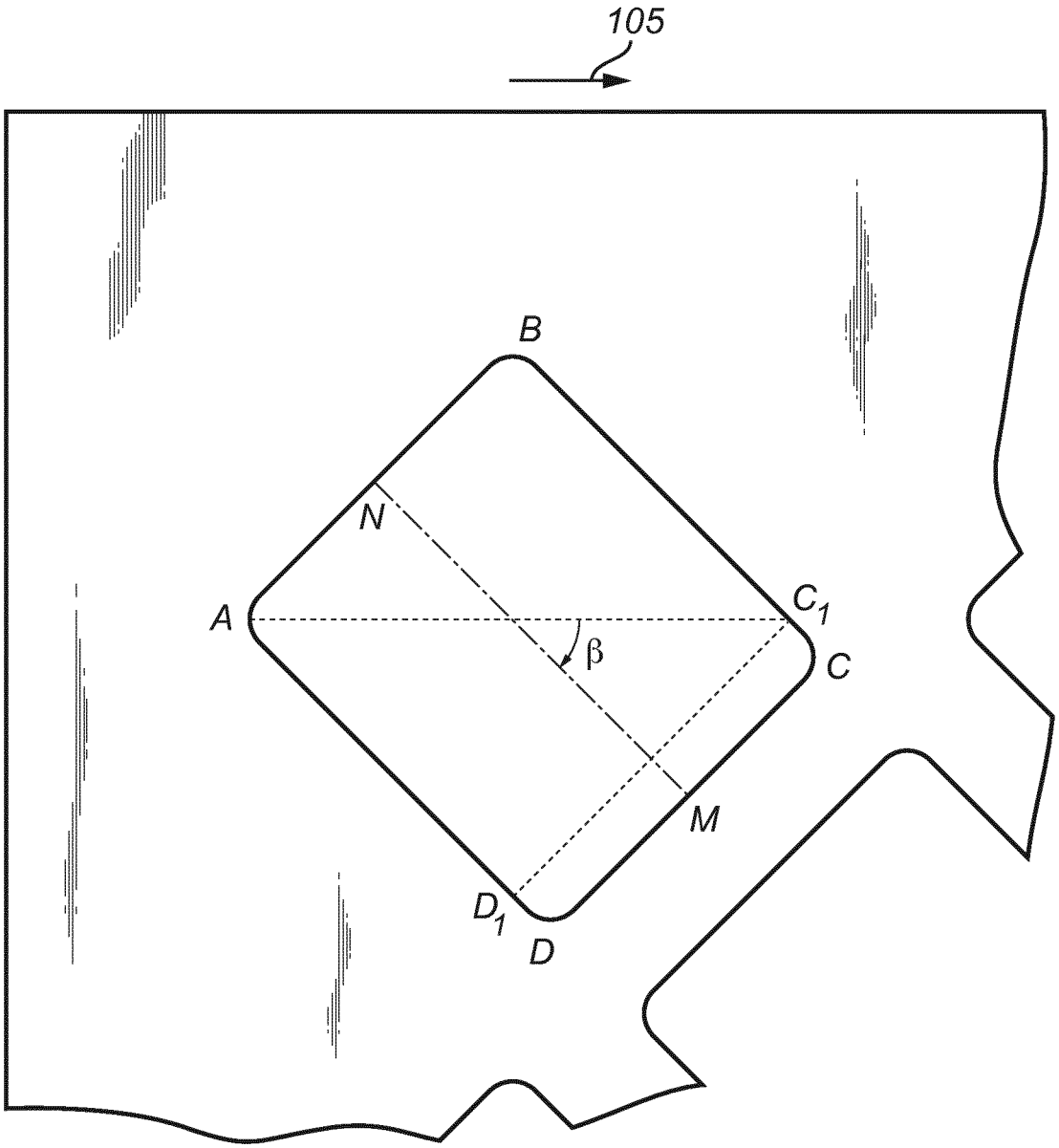
FIG. 6 is a magnified plan view of a part at upper left corner of a screening media of FIG. 5.

FIG. 5 discloses a plan view of a screening media according to another embodiment. FIG. 6 is a magnified plan view of a part at upper left corner of a screening media of FIG. 5. The screening media has similar opening shape as in FIGS. 1 to 3, except that the openings are arranged in different orientation. The major axes MN of the rectangular apertures incline about 45 degrees relative to the material flow direction 105, but in clockwise direction from material flow direction 105 as indicated in angle β in FIG. 6. Rectangle opening ABCD may be considered as being scaled from a virtual square opening $ABC_1D_1$ along the axis NM that is parallel to edge AD, wherein the inscribed circle of $ABC_1D_1$ corresponds to the desired maximal material particle size. The hole is oriented such that diagonal $AC_1$ is in line with the material flow direction 105 and bisects the proximal interior angle ∠BAD. Now, edges AB and BC, AD and DC form respectively a plow-shaped bank relative to the material flow direction 105, where the edges AB and BC are substantially normal to each other. With such a design, similar screening efficiency improvement can be achieved as the design shown in FIGS. 1 to 3.

Figure 7:
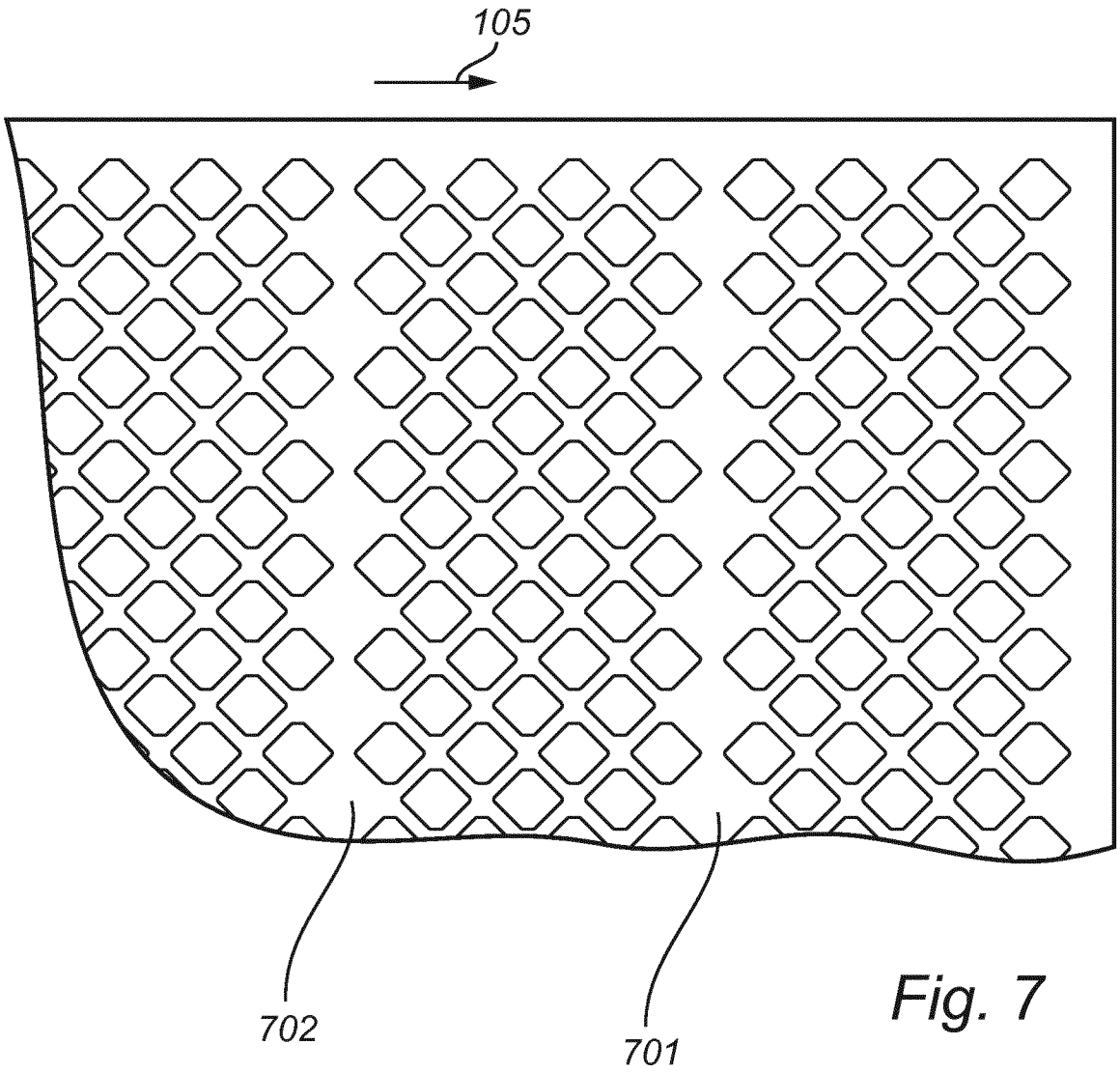
FIG. 7 is plan view of a screening media according to another specific implementation of the present invention.
Figure 8:
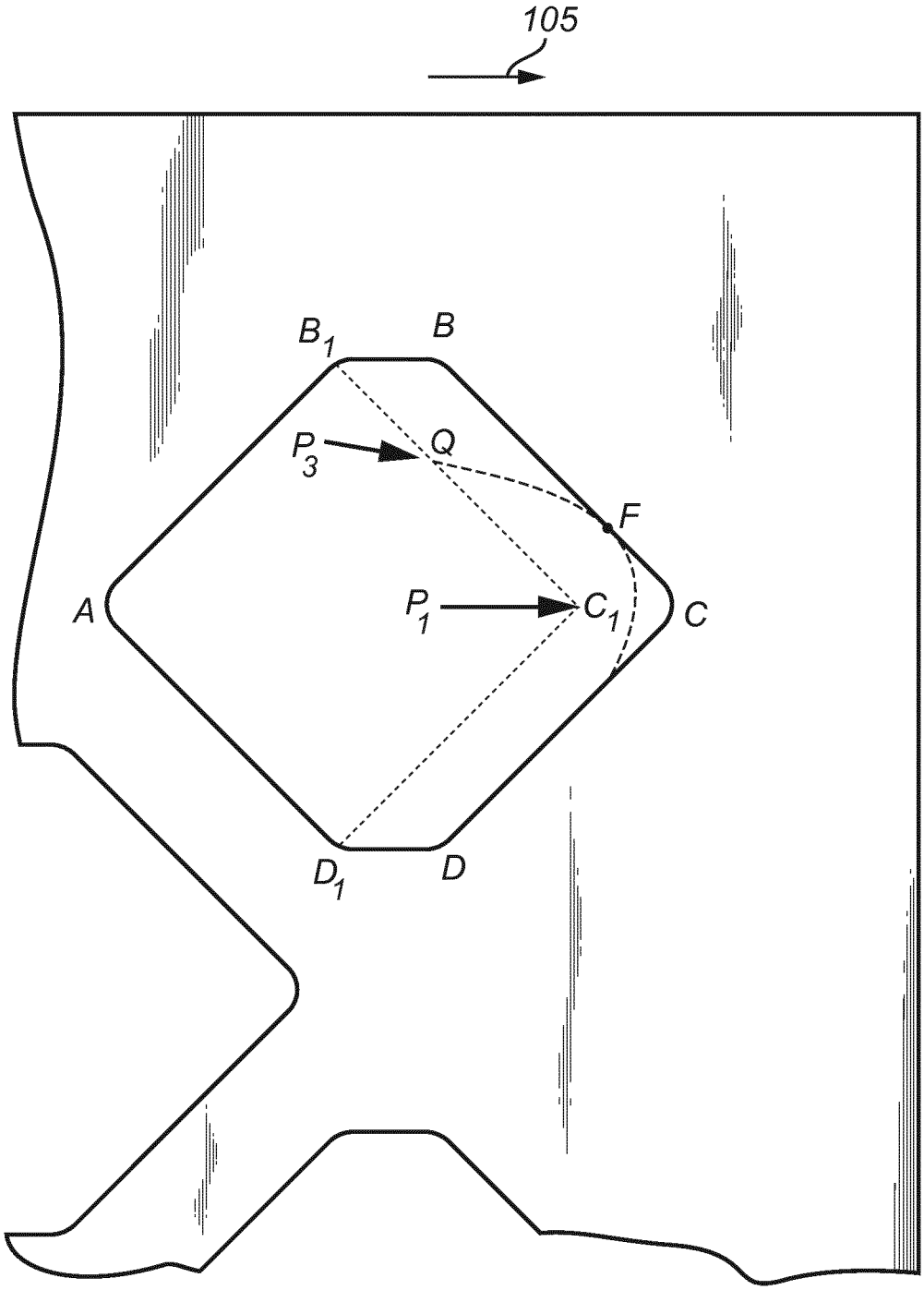
FIG. 8 is a magnified plan view of a part at upper right corner of a screening media of FIG. 7.

Referring to FIG. 7, a plan view of a screening media according to another specific implementation is shown. FIG. 8 is a magnified plan view of a part of the screening media of FIG. 7. In this design, the openings are in hexagon form, the openings are also arranged in a tessellation scheme of a lattice structure. It is optional that, from consideration of stiffness etc., certain columns 701 and 702 of main body may be not punched with holes, the hexagon opening $AB_1BCDD_1$ can be considered as being expanded from a virtual square opening $AB_1C_1D_1$ along the axis $AC_1$, that is, the area of $AB_1C_1D_1$ is expanded as if the edge BC and CD are translated respectively along the direction $AC_1$, wherein the inscribed circle of $AB_1C_1D_1$ corresponds to the desired maximal material particle size. The hole is oriented such that diagonal $AC_1$ is in line with the material flow direction 105 and bisects the proximal interior angle $\angle B_1AD_1$. Now, edges $AB_1$ together with $B_1B$ and BC, edges $AD_1$ together with $D_1D$ and DC form respectively a plow-shaped bank relative to the material flow direction 105, where the edges $AB_1$ and BC are substantially normal to each other. In such a design, edge $AB_1$ has a length of 14 mm, $B_1B$ is set as 4 mm, similar screening efficiency improvement can be achieved as the design shown in FIGS. 1 to 3.

Analogously, the screening process will be briefly illustrated in a virtual manner, with aid of virtual square hole $AB_1C_1D_1$ as comparison. Supposing a particle is moving along direction $P_1$ to enter the hole and approach the end vertex $C_1$ of the virtual hole, and is not successful in passing through the virtual hole, it may be stuck there or flit the hole. However, due to the hole already being expanded, the particle has further spacing to allow it descend until reaching point C, due to the drop movement in vertical plane (reference to FIG. 3A), there is no longer chance for the particle to escape from the hole, but fall through the hole. If a particle is moving along the plow-shaped bank to enter the hole and reach point Q in direction $P_3$, the effect is similar as illustrated with respect to FIG. 2.

Figure 9:
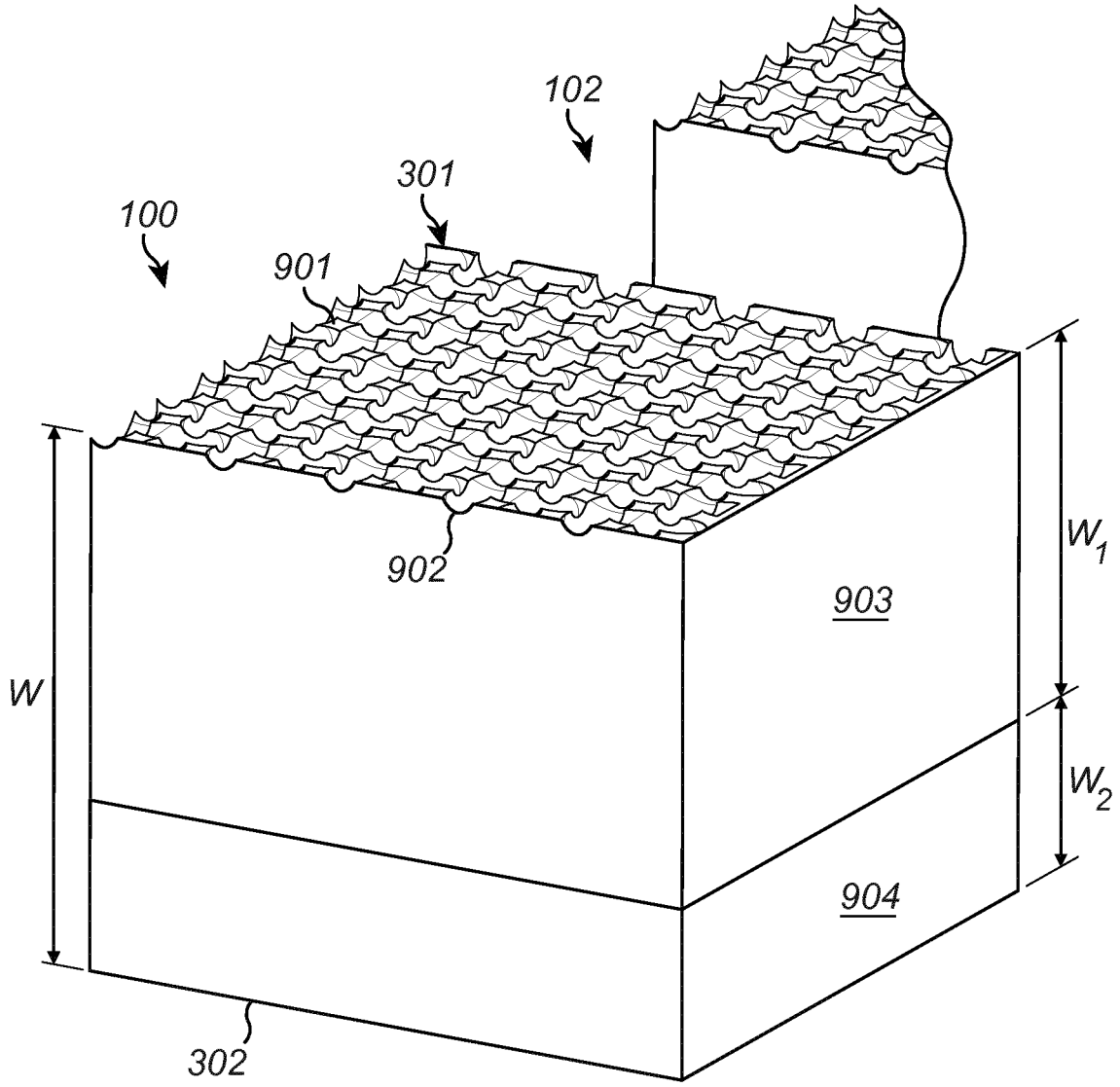
FIG. 9 is a magnified section view through part of the screening media of FIG. 4.

FIG. 9 shows a magnified section view through part of the screening media of FIG. 4. Screen media 100 according to the specific implementation is formed as a two-piece composite having an uppermost first layer 903 and a lowermost second layer 904, the two layers may be bonded together. First layer 903 is formed from a rubber material whilst second layer 904 is formed from a polyester material having a hardness greater than that of first layer. A thickness $W_1$ of the first layer is greater than a corresponding thickness $W_2$ of the second layer 904. According to one specific implementation, a thickness of first layer 903 is in a range 1 mm to 6 mm and the thickness $W_2$ of second layer 904 is in a range 0.4 mm to 1.0 mm. The function of second layer 904 is to provide rigidity and support to the relatively softer first layer 903.

Figure 10:
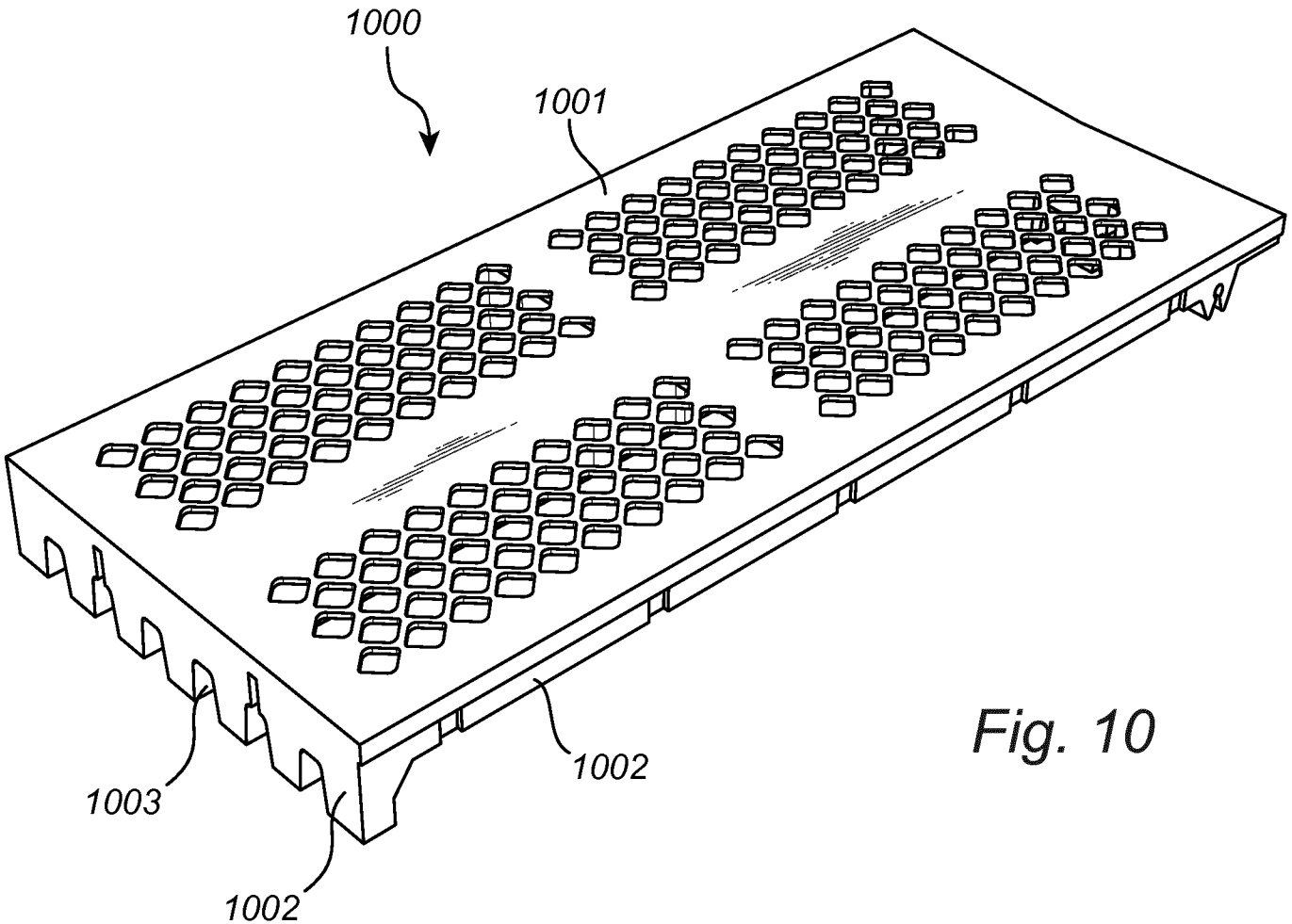
FIG. 10 is a perspective view of screening media according to a specific implementation of the present invention.

FIG. 10 discloses a screening media 1000 according to a specific implementation of the present invention. The screening media comprises a screen sheet 1001 and a support structure 1002 at its back face. Support structure 1002 serves as a carrier frame to the relatively softer screen sheet 1001 and provides strength and rigidity. The screen sheet 1001 and support structure 1002 may be made of the same material and be formed into integral structure as a single piece, thus the screening media can be a modular design. Support structure 1002 may include a number of fixing arrangements such as mortise or groove or wedge or tongue etc. 1003 for attaching the screening media 1000 onto a screening equipment, or for inter-connecting to a neighbouring screening media in assembly.

Figure 11A:
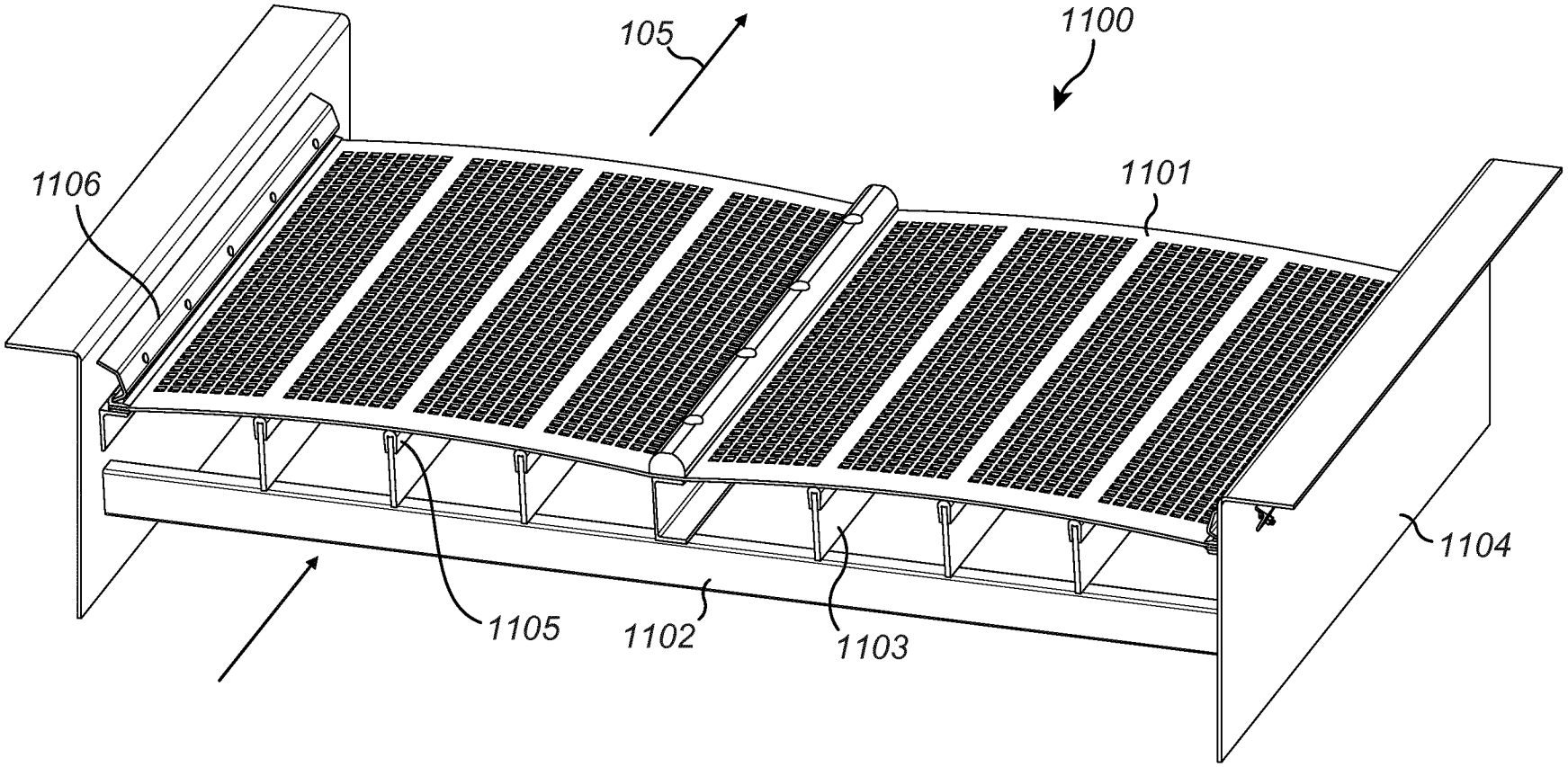
FIG. 11A is a perspective view of a screening apparatus having lengthwise and widthwise extending support beams to seat screening media between respective sidewalls according to a specific implementation of the present invention.

FIG. 11A illustrates a part of a screening apparatus (or called a screen deck, or a screening module) 1100 in which a mat-like screen media 1101 is pre-tensioned to extend lengthwise and widthwise between a pair of respective sidewalls 1104. Media 1101 is supported at its underside by a plurality of lengthwise extending beams 1103 that are in turn mounted on a lower support frame 1102 formed from one or a plurality of cross beams extending between sidewalls 1104. Media 1101 is clamped on to the sidewalls 1104 by clamp bars 1106. The screening apparatus also uses rubber capping 1105 to prevent the screen media from wear. Media 1101 may be pre-tensioned in the widthwise direction between sidewalls 1104 and/or in the lengthwise direction between a first end and a second end (not shown) where the length of the media 1101 corresponds to a flow direction of the material to be screened indicated generally by arrow 105.

Figure 11B:
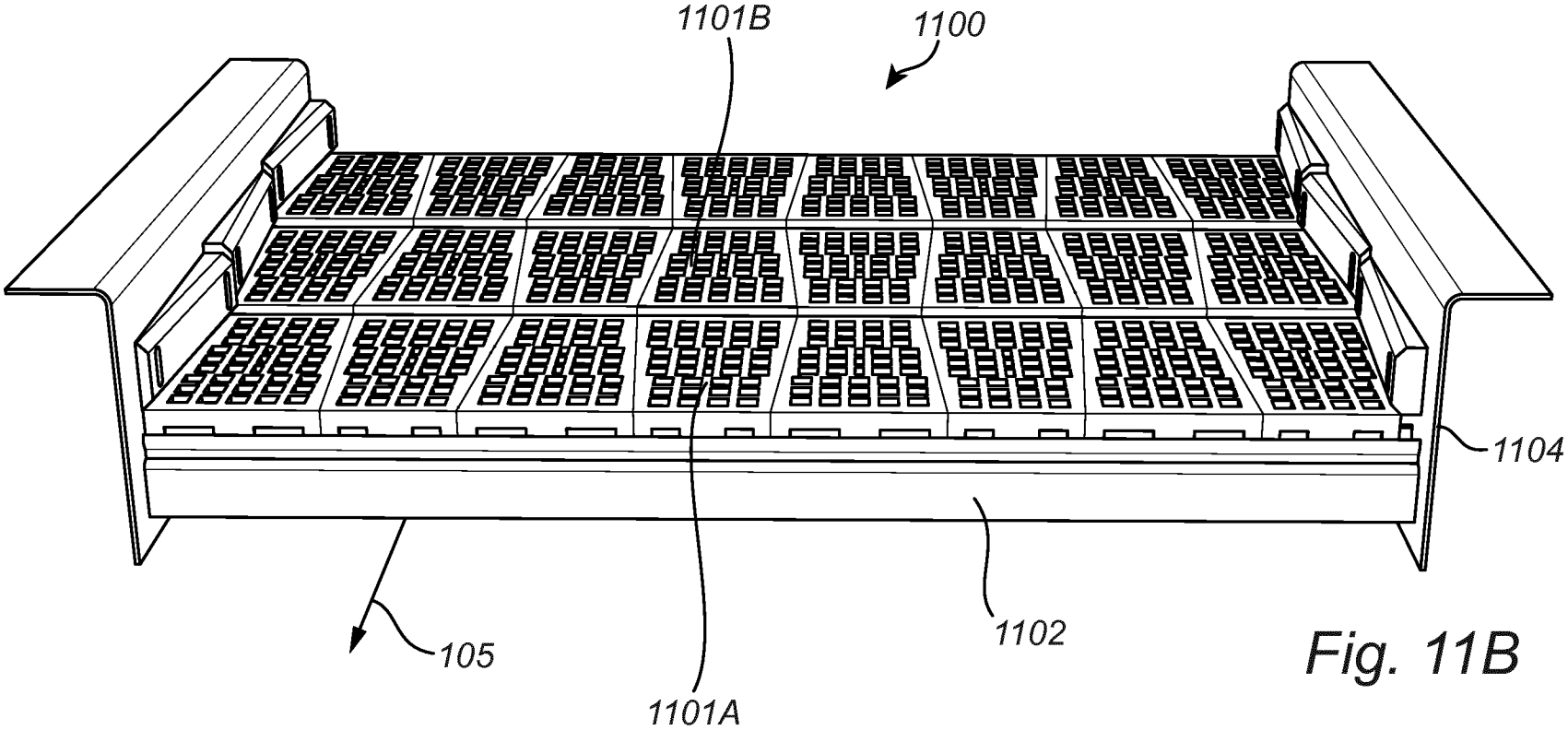
FIG. 11B is a perspective view of a screening apparatus according to another specific implementation of the present invention.

FIG. 11B illustrates a part of a screening apparatus 1100 which includes multiple pieces of screen media according to FIG. 10. The screen media are mounted sequentially along the defined material flow direction 105 on a lower support frame 1102 formed from one or a plurality of cross beams extending between sidewalls 1104, the media are arranged in rows transverse to the defined material flow direction 105, a downstream screening media 1101A has a sunk or lower contact face relative to an upstream neighbouring screening media 1101B.

Figure 12:
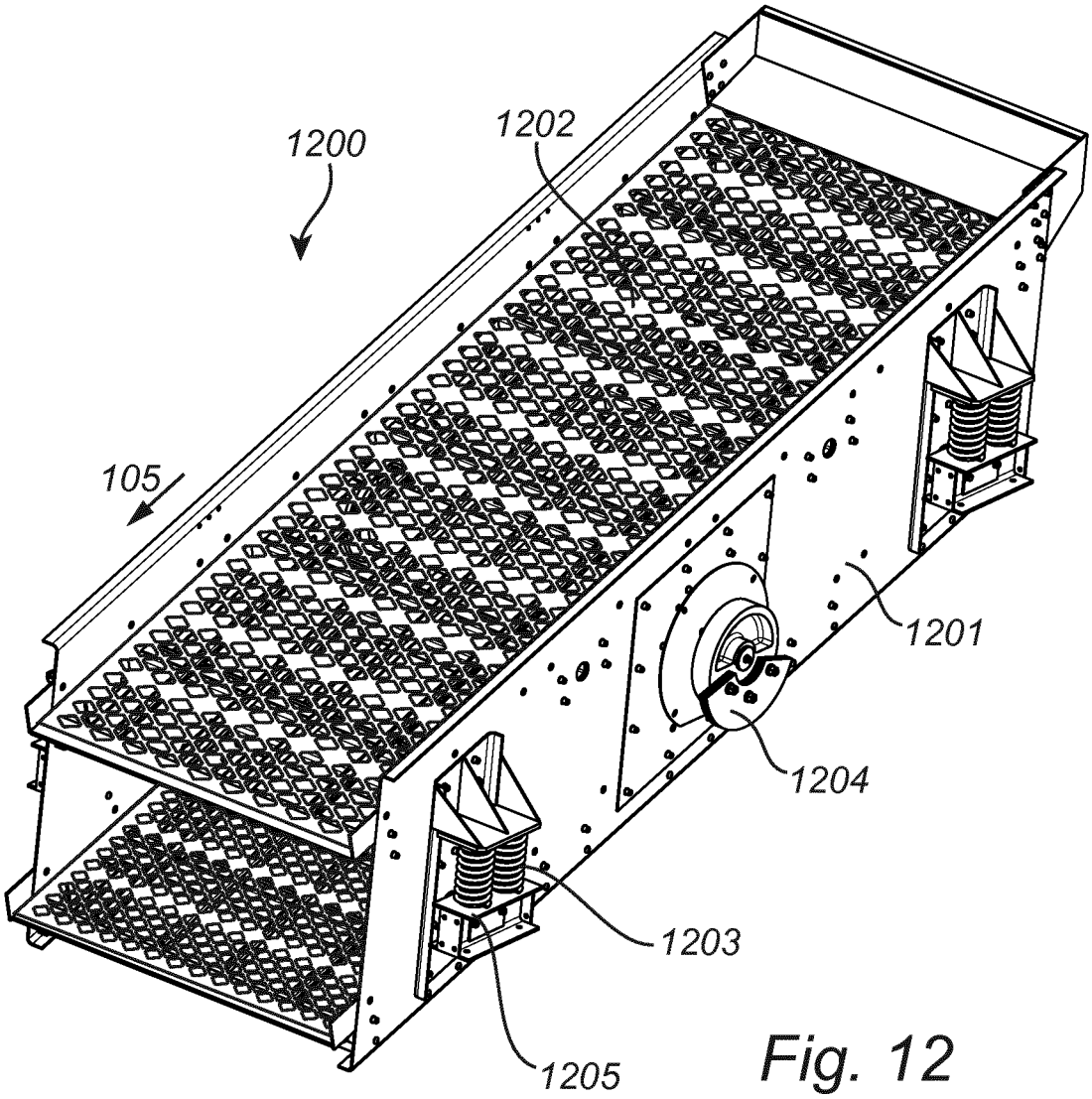
FIG. 12 is a perspective view of a screening equipment according to a specific implementation of the present invention.

FIG. 12 shows a screening equipment according to a specific implementation of the present invention. The screening equipment 1200 comprises one or more screening media 1202 as disclosed herein (referring to FIGS. 1 to 10), a trough-alike frame 1201 for supporting the screening media 1202, a suspension or articulation mechanism 1203, a vibration generating means 1204 and undercarriage 1205.

The frame 1201 is movably coupled to undercarriage 1205 via the suspension mechanism 1203 such as a spring system. Vibration generating means 1204 is adapted to impart consecutive circular or reciprocating vibratory motion onto the screening media, it may include an electric vibration motor (not shown) capable of exerting vertical vibration movements of certain frequency, it is appreciated that other vibration generating means operable to bring back and forth movements of certain frequency may be used. The defined material flow direction 105 of the screening media 1202 is parallel to the sidewalls or longitudinal direction of the screening equipment.

In operation, the screening equipment 1200 is brought to an intended position, the next step is to set the screening equipment to match a defined material flow direction, i.e. to let the defined material flow direction (associated with the screening equipment) be in line with the actual material flow direction; start the motor to generate vibrations onto the screening media; the generated vibration and gravity drive the material moving on the screening media or passing through the openings of the screening media.

It is to be understood that the embodiments of the invention disclosed herein are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

The forgoing examples are illustrative of the principles of the present invention in one or more particular applications, accordingly, it is not intended that the invention be limited.

The invention claimed is:

1. A screening media for being arranged in a screening equipment for screening material, the media comprising:

a main body having a contact face arranged to contact material to be screened and a back face located opposite the contact face; and a plurality of openings extending through the main body between the contact and back faces, wherein a cross sectional area of the plurality of openings in a plane perpendicular to a thickness of the media is a polygon that is a convex and non-regular polygon, and wherein the plurality of openings are arranged in an orientation such that a line through a most proximal vertex of the polygon and parallel to a defined material flow direction divides a most proximal interior angle of the polygon.

2. The media as claimed in claim 1, wherein the most proximal interior angle is substantially a right angle, and the line through the proximal vertex bisects the most proximal interior angle.

3. The media as claimed in claim 1, wherein the non-regular polygon is a parallelogon being derivable from a regular polygon by expanding the regular polygon in such a way that a separation defined between the most proximal vertex and a most distal vertex is increased, wherein the regular polygon having a side length corresponding to a desired maximal material particle size.

4. The media as claimed in claim 1, wherein the non-regular polygon has a rectangular shape having two short sides, the short sides of the non-regular polygon having a length corresponding to a desired maximal material particle size.

5. The media as claimed in claim 1, wherein the non-regular polygon is a hexagon that includes a first pair of parallel opposite sides, a second pair of parallel opposite sides, and a third pair of parallel opposite sides, the first and second pairs of sides having an equal length, the first and second pairs of sides having a length corresponding to the desired maximal material particle size, the third pair of sides having a shorter length than the first and second pairs of sides, wherein the first and second pairs of sides are perpendicular to each other.

6. The media as claimed in claim 1, wherein the main body has a textured pattern provided at the contact face, the pattern extending over all or a majority of the contact face.

7. The media as claimed in claim 6, wherein the pattern is represented by peaks and troughs at the contact face, a depth of the pattern being defined as a separation distance between projections of the peaks and troughs on an axis parallel to the thickness of the media, wherein the depth of the pattern is in a range of 5% to 70% of a total thickness of the media between the bottom face and the peaks of the contact face.

8. The media as claimed in claim 7, wherein the range of the depth is 0.05 mm to 10 mm.

9. The media as claimed in claim 1, wherein a tessellation scheme of the plurality of openings is a lattice structure.

10. The media as claimed in claim 1, wherein the main body is a single piece of material and is made of a rubber or polymer material.

11. The media as claimed in claim 1, wherein the main body includes at least a first layer and a second layer bonded or attached together to form a composite structure, the first layer defining the contact face and the second layer defining the bottom face, the first layer being made of a first material and the second layer being made of a second material, wherein the second material has material characteristics that are different from material characteristics of the first material.

12. The media as claimed in claim 1, wherein a width, length or diameter of each of the plurality of openings in a plane perpendicular to the thickness of the media is in a range of 1 mm to 50 mm.

13. The media as claimed in claim 1, wherein a cross sectional area of the plurality of openings in a plane perpendicular to the thickness of the media is generally uniform or increases through the thickness of the main body between the contact and bottom faces.

14. The media as claimed in claim 1, wherein the main body includes a support structure for supporting the screening media, the support structure being formed together with the screening media as an integral structure.

15. A screening equipment for screening material, comprising:

at least one screening media as claimed in claim 1;

a frame for supporting the at least one screening media; and a vibration generating means for imparting circular or reciprocating vibratory motion onto the at least one screening media.

16. A method for processing material in a screening equipment as claimed in claim 15, the screening equipment including the at least one screening media, the method comprising:

setting the screening equipment to match a defined material flow direction;

generating vibration of the screening media with the screening equipment; and driving the material moving on the screening media or passing through the openings of the screening media by the generated vibration and gravity, wherein a cross sectional area of the plurality of openings of the screening media in a plane perpendicular to the thickness of the media is of a polygon that is convex and non-regular polygon, and wherein a line through a most proximal vertex of the polygon and parallel to the defined material flow direction divides the most proximal interior angle of the polygon.

17. A screening module for screening bulk material, the module comprising:

a pair of sidewalls;

a plurality of support means, wherein the plurality of support means together with the pair of sidewalls form a frame structure; and at least one screening media as claimed in claim 1, mounted or indirectly mounted upon the plurality of support means and extending between the sidewalls.

18. The screening module as claimed in claim 17, wherein the screening module includes two or more screening media arranged sequentially along the defined material flow direction, wherein a downstream screening media has a lowered contact face relative to an upstream neighbouring screening media.

* * * * *